US005827127A

United States Patent [19]

Firth

[11] Patent Number: 5,827,127

[45] Date of Patent: Oct. 27, 1998

[54] GOLF SWING RECORDING SYSTEM

[76] Inventor: Malcolm Firth, 16 Gate House Rd., Fort Lauderdale, Fla. 33308

[21] Appl. No.: 960,980

[22] Filed: Oct. 30, 1997

[51] Int. Cl.[6] ..... A63B 69/36

[52] U.S. Cl. ..... 473/266; 473/222; 434/252

[58] Field of Search ..... 473/131, 140, 473/141, 150, 151–156, 266, 278, 407, 168, 221, 219, 222; 434/252

[56] References Cited

U.S. PATENT DOCUMENTS

| | | | |
|---|---|---|---|
| 3,408,750 | 11/1968 | McCollough et al. | 473/266 |
| 3,820,133 | 6/1974 | Adorney et al. | 434/252 |
| 3,918,073 | 11/1975 | Henderson et al. | 473/266 |
| 5,249,967 | 10/1993 | O'Leary et al. | 434/252 |
| 5,297,796 | 3/1994 | Peterson | 473/266 |

FOREIGN PATENT DOCUMENTS

| | | | |
|---|---|---|---|
| 2268080 | 1/1994 | United Kingdom | 273/183.1 |

*Primary Examiner*—Steven Wong

[57] ABSTRACT

A new golf swing recording system for allowing a golfer to visualize their swing from various angles. The inventive device includes a frame member having a generally rectangular configuration. The frame member includes a top wall, a rear wall, opposed side walls, an open front and an open bottom. The top wall, the rear wall and the opposed side walls each have diagonal interconnected cross members. The frame member is dimensioned for receiving a club swinging golfer therein. Four video cameras are secured to the diagonal interconnected cross members of the frame member. The four video cameras include a top camera secured to the top wall, a rear camera secured to the rear wall and two opposed side cameras secured to the opposed side walls. A video recorder is secured to the rear wall of the frame member. The video recorder is in communication with the four video cameras.

4 Claims, 2 Drawing Sheets

10
12
14
16
18
20
22
24
26
30
32
34
34
36

36
38
38
40
1
2
3
4

GOLF SWING RECORDING SYSTEM

BACKGROUND OF THE INVENTION

1. Field of the Invention

The present invention relates to golf practice aids and more particularly pertains to a new golf swing recording system for allowing a golfer to visualize their swing from various angles.

2. Description of the Prior Art

The use of golf practice aids is known in the prior art. More specifically, golf practice aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf practice aids include U.S. Pat. No. 5,210,603 to Sabin; U.S. Pat. No. 5,333,061 to Nakashima et al.; U.S. Pat. No. 5,342,054 to Chang et al.; U.S. Pat. No. 5,184,295 to Mann; U.S. Pat. No. 5,174,566 to Kelnhofer; and U.S. Pat. No. Des. 360,646 to Nomura.

While these devices fulfill their respective, particular objectives and requirements, the aforementioned patents do not disclose a new golf swing recording system. The inventive device includes a frame member having a generally rectangular configuration. The frame member includes a top wall, a rear wall, opposed side walls, an open front and an open bottom. The top wall, the rear wall and the opposed side walls each have diagonal interconnected cross members. The frame member is dimensioned for receiving a club swinging golfer therein. Four video cameras are secured to the diagonal interconnected cross members of the frame member. The four video cameras include a top camera secured to the top wall, a rear camera secured to the rear wall and two opposed side cameras secured to the opposed side walls. A video recorder is secured to the rear wall of the frame member. The video recorder is in communication with the four video cameras.

In these respects, the golf swing recording system according to the present invention substantially departs from the conventional concepts and designs of the prior art, and in so doing provides an apparatus primarily developed for the purpose of allowing a golfer to visualize their swing from various angles.

SUMMARY OF THE INVENTION

In view of the foregoing disadvantages inherent in the known types of golf practice aids now present in the prior art, the present invention provides a new golf swing recording system construction wherein the same can be utilized for allowing a golfer to visualize their swing from various angles.

The general purpose of the present invention, which will be described subsequently in greater detail, is to provide a new golf swing recording system apparatus and method which has many of the advantages of the golf practice aids mentioned heretofore and many novel features that result in a new golf swing recording system which is not anticipated, rendered obvious, suggested, or even implied by any of the prior art golf practice aids, either alone or in any combination thereof.

To attain this, the present invention generally comprises a frame member having a generally rectangular configuration. The frame member includes a top wall, a rear wall, opposed side walls, an open front and an open bottom. The open bottom has wheels disposed on four corners thereof. The top wall, the rear wall and the opposed side walls each have diagonal interconnected cross members. The frame member is dimensioned for receiving a club swinging golfer therein. Four video cameras are secured to the diagonal interconnected cross members of the frame member. The four video cameras include a top camera secured to the top wall, a rear camera secured to the rear wall and two opposed side cameras secured to the opposed side walls. A video recorder is secured to the rear wall of the frame member. The video recorder is in communication with the four video cameras. The video recorder has four tape recording portions that correspond with the four video cameras for recording on tapes positioned therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing recording system apparatus and method which has many of the advantages of the golf practice aids mentioned heretofore and many novel features that result in a new golf swing recording system which is not anticipated, rendered obvious, suggested, or even implied by any of the prior art golf practice aids, either alone or in any combination thereof.

It is another object of the present invention to provide a new golf swing recording system which may be easily and efficiently manufactured and marketed.

It is a further object of the present invention to provide a new golf swing recording system which is of a durable and reliable construction.

An even further object of the present invention is to provide a new golf swing recording system which is susceptible of a low cost of manufacture with regard to both materials and labor, and which accordingly is then susceptible of low prices of sale to the consuming public, thereby making such golf swing recording system economically available to the buying public.

Still yet another object of the present invention is to provide a new golf swing recording system which provides in the apparatuses and methods of the prior art some of the advantages thereof, while simultaneously overcoming some of the disadvantages normally associated therewith.

Still another object of the present invention is to provide a new golf swing recording system for allowing a golfer to visualize their swing from various angles.

Yet another object of the present invention is to provide a new golf swing recording system which includes a frame member having a generally rectangular configuration. The frame member includes a top wall, a rear wall, opposed side walls, an open front and an open bottom. The top wall, the rear wall and the opposed side walls each have diagonal interconnected cross members. The frame member is dimensioned for receiving a club swinging golfer therein. Four video cameras are secured to the diagonal interconnected cross members of the frame member. The four video cameras include a top camera secured to the top wall, a rear camera secured to the rear wall and two opposed side cameras secured to the opposed side walls. A video recorder is secured to the rear wall of the frame member. The video recorder is in communication with the four video cameras.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
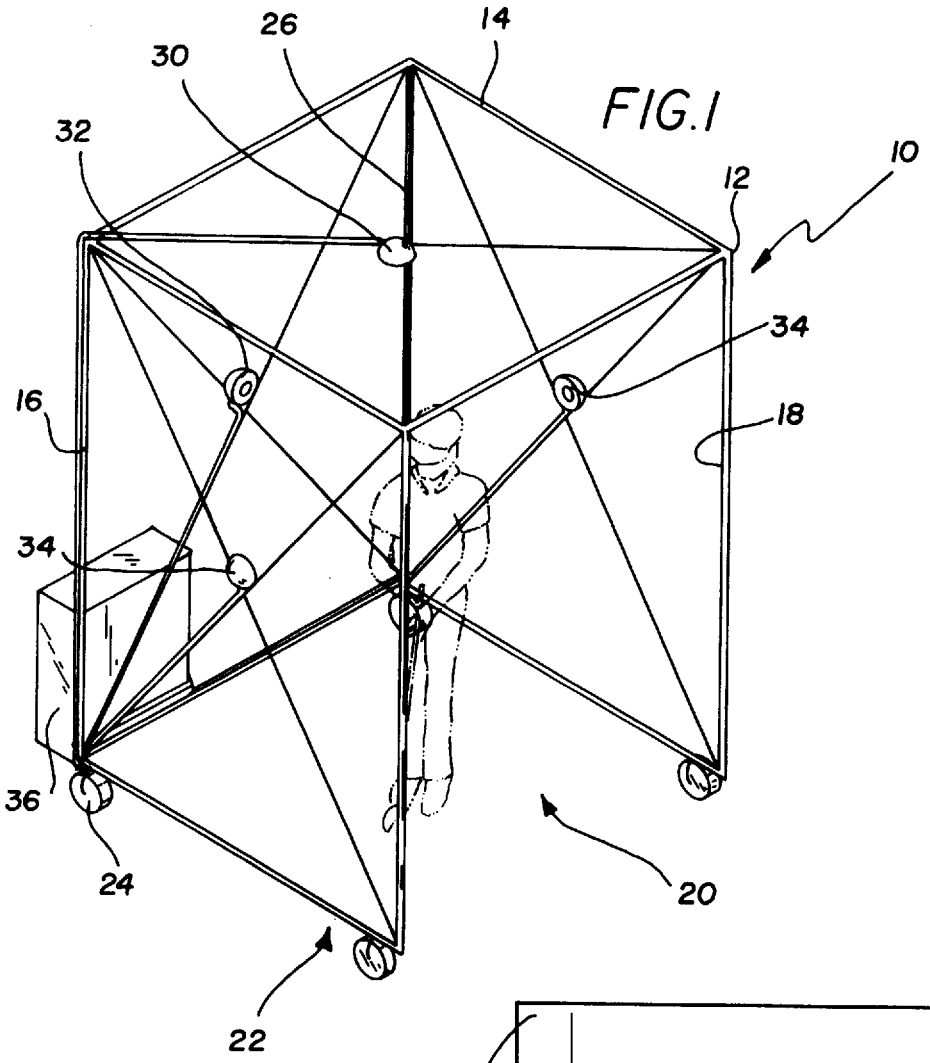
FIG. 1 is a perspective view of a new golf swing recording system according to the present invention.
Figure 2:
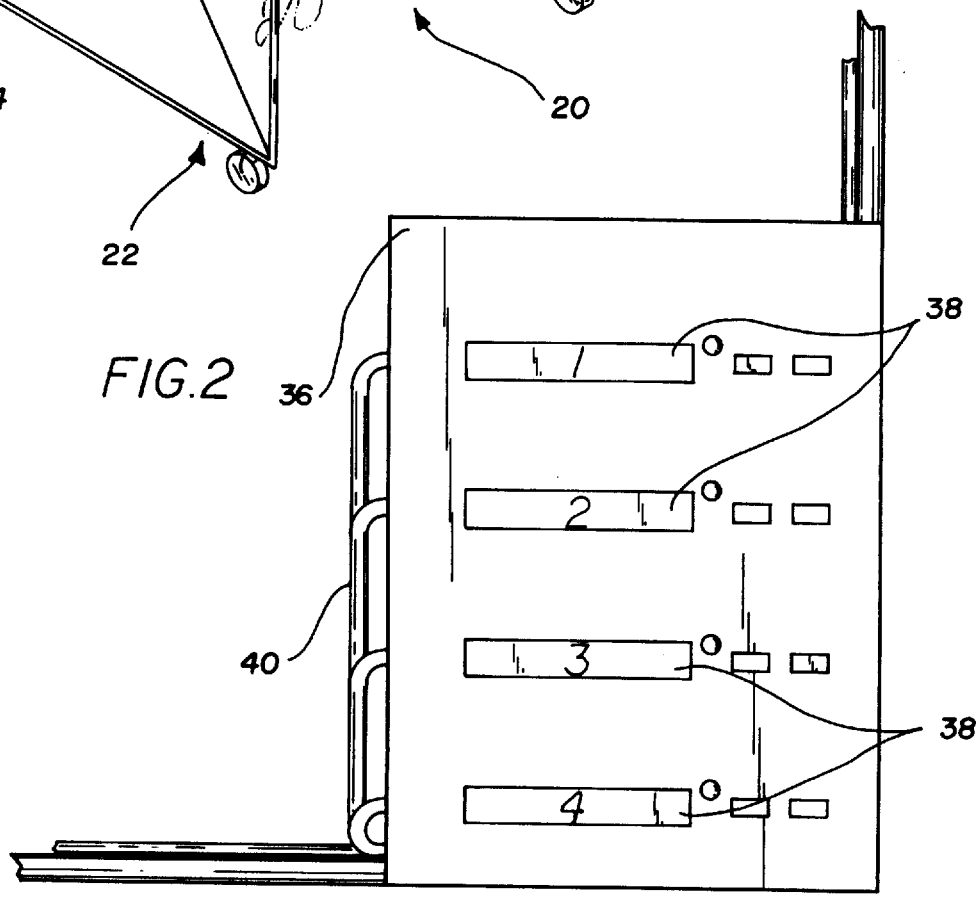
FIG. 2 is a front view of the video recorder unit of the present invention.
Figure 3:
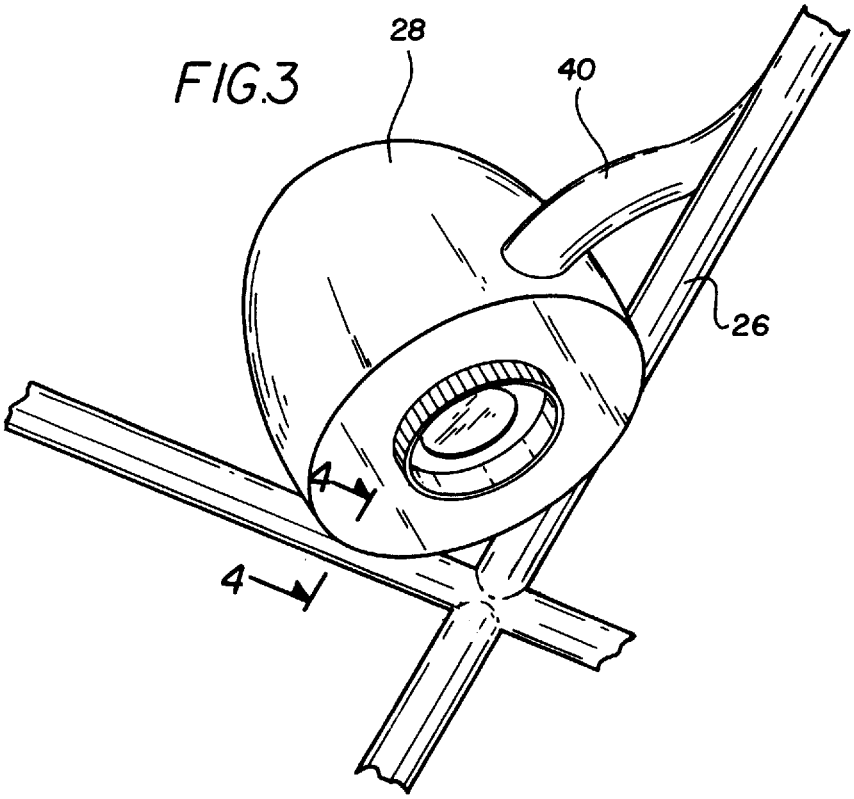
FIG. 3 is a perspective view of one of the cameras of the present invention.
Figure 4:
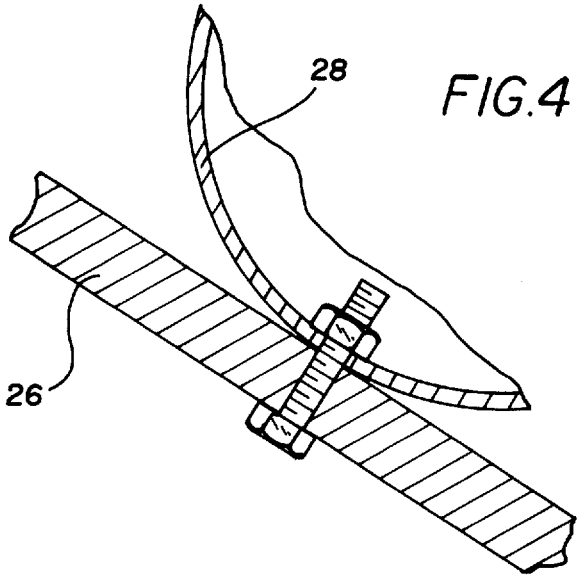
FIG. 4 is a cross-sectional view of the present invention as taken along line 4—4 of FIG. 3.

With reference now to the drawings, and in particular to FIGS. 1 through 4 thereof, a new golf swing recording system embodying the principles and concepts of the present invention and generally designated by the reference numeral 10 will be described.

As best illustrated in FIGS. 1 through 4, the golf swing recording system 10 comprises a frame member 12 having a generally rectangular configuration. The frame member 12 includes a top wall 14, a rear wall 16, opposed side walls 18, an open front 20 and an open bottom 22. The open bottom 22 has wheels 24 disposed on four corners thereof. The top wall 14, the rear wall 16 and the opposed side walls 18 each have diagonal interconnected cross members 26. The frame member 12 is dimensioned for receiving a club swinging golfer therein.

Four video cameras 28 are secured to the diagonal interconnected cross members 26 of the frame member 12. The four video cameras include a top camera 30 secured to the top wall 14, a rear camera 32 secured to the rear wall 16 and two opposed side cameras 34 secured to the opposed side walls 18.

A video recorder 36 is secured to the rear wall 16 of the frame member 12. The video recorder 36 is in communication with the four video cameras 28. The video recorder 36 has four tape recording portions 38 that correspond with the four video cameras 28 for recording on tapes positioned therein. The video recorder 36 has cable 40 extending outwardly therefrom for coupling with the four video cameras 28.

In use, the present invention would be installed at a golf driving range or golf course to allow a golfer to videotape their swing from various angles. The frame member 12 would measure approximately twelve feet wide by twelve feet long by twelve feet high with an optional fabric shell disposed thereover. The video cameras 28 would record a golfer's swing from four different angles, and the images would be recorded on four separate video tapes or synchronized onto a single video tape. The frame member 12 includes the wheels 24 as an optional feature to make it easy to move. Additionally, a rubber mat could be provided to serve as a hitting mat for the golfer.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new golf swing recording system for allowing a golfer to visualize their swing from various angles comprising, in combination:

a frame member having a generally rectangular configuration, the frame member including a top wall, a rear wall, opposed side walls, an open front and an open bottom, the open bottom having wheels disposed on four corners thereof, the top wall, the rear wall and the opposed side walls each having diagonal interconnected cross members, the frame member being dimensioned for receiving a club swinging golfer therein;

four video cameras secured to the diagonal interconnected cross members of the frame member, the four video cameras including a top camera secured to the top wall, a rear camera secured to the rear wall and two opposed side cameras secured to the opposed side walls; and a video recorder secured to the rear wall of the frame member, the video recorder being in communication with the four video cameras, the video recorder having four tape recording portions corresponding with the four video cameras for recording on tapes positioned therein.

2. A new golf swing recording system for allowing a golfer to visualize their swing from various angles comprising, in combination:

a frame member having a generally rectangular configuration, the frame member including a top wall, a rear wall, opposed side walls, an open front and an open bottom, the top wall, the rear wall and the opposed side walls each having diagonal interconnected cross members, the frame member being dimensioned for receiving a club swinging golfer therein;

four video cameras secured to the diagonal interconnected cross members of the frame member, the four video cameras including a top camera secured to the top wall, a rear camera secured to the rear wall and two opposed side cameras secured to the opposed side walls; and a video recorder secured to the rear wall of the frame member, the video recorder being in communication with the four video cameras.

3. The golf swing recording system as set forth in claim 2 wherein the video recorder has four tape recording portions corresponding with the four video cameras for recording on tapes positioned therein.

4. The golf swing recording system as set forth in claim 2 wherein the open bottom of the frame member has wheels disposed on four corners thereof.

* * * * *